United States Patent [19]

Meussdoerffer

[11] Patent Number: 4,950,286

[45] Date of Patent: Aug. 21, 1990

[54] COMFORTER OF SILICONE RUBBER

[75] Inventor: Johann N. Meussdoerffer, Leverkusen, Fed. Rep. of Germany

[73] Assignee: Bayer Aktiengesellschaft, Leverkusen-Bayerwerk, Fed. Rep. of Germany

[21] Appl. No.: 283,498

[22] Filed: Dec. 12, 1988

[30] Foreign Application Priority Data

Dec. 23, 1987 [DE] Fed. Rep. of Germany ..... 3743748

[51] Int. Cl.[5] ..... A61J 17/00

[52] U.S. Cl. ..... 606/236

[58] Field of Search ..... 128/359, 360; 215/11.1, 215/160; 528/32–33; 606/234–236

[56] References Cited

U.S. PATENT DOCUMENTS

| | | | |
|---|---|---|---|
| 1,236,235 | 8/1917 | Tufts | 128/360 |
| 2,462,786 | 2/1949 | Steckler | 128/360 |
| 3,669,117 | 6/1972 | Herbst | 128/360 |
| 3,825,014 | 7/1974 | Wroten | 128/360 |
| 4,026,297 | 5/1977 | Kobayashi | 128/359 |
| 4,528,354 | 7/1985 | McDougal | 528/33 |
| 4,539,357 | 9/1985 | Bobear | 528/31 |
| 4,676,386 | 6/1987 | Phlaphongphanich | 215/11.1 |

FOREIGN PATENT DOCUMENTS

| | | | |
|---|---|---|---|
| 1902772 | 6/1969 | Fed. Rep. of Germany . | |
| 2007112 | 9/1971 | Fed. Rep. of Germany | 128/359 |
| 2401117 | 7/1974 | Fed. Rep. of Germany . | |
| 3347876 | 5/1983 | Fed. Rep. of Germany . | |
| 3232506 | 3/1984 | Fed. Rep. of Germany | 128/360 |

*Primary Examiner*—C. Fred Rosenbaum
*Assistant Examiner*—William Lewis
*Attorney, Agent, or Firm*—Connolly & Hutz

[57] ABSTRACT

A silicone rubber comforter or pacifier for infants to suck or chew for oral gratification comprises an outer rubber shell and an inner filling of softer rubber wherein the outer shell comprises a silicone rubber of high tear propagation resistance having a Shore A hardness of 30 to 60 and the inner filling comprises a soft silicone rubber having a Shore A harness of less than 5, said outer shell and inner filling being bonded together by a chemical bond, mechanical bond or both.

4 Claims, No Drawings

COMFORTER OF SILICONE RUBBER

A COMFORTER OF SILICONE RUBBER

The present invention relates to improved silicone rubber comforters and pacifiers which comprise an outer shell of silicone rubber and a filling material for the outer shell.

BACKGROUND OF THE INVENTION

Comforters and pacifiers in the past have been manufactured from a variety of different materials and in a variety of different designs. In the past, only natural latex was available for this purpose whereas, more recently, a greater preference has been shown for silicone rubber.

The advantages of silicone rubber lie above all in its excellent ageing behavior, in its ease of handling for cleaning and sterilization, in its high transparency for better control of clêanness, its ease of processing injection moulding machines and the like.

Hitherto, comforters of the natural latex or silicone rubber have normally been made in a hollow mould with wall thicknesses of up to about 2 mm, for which purpose a material having a Shore A hardness of 30 to 60 was used. Larger wall thicknesses were not selected because otherwise the comforter would have felt too hard and would not have been taken by the infant. Solid comforters of this material were undesirable for the same reasons.

However, since the force generally required to destroy a comforter increases proportionally with the wall thickness, it is obvious that stable and hence thick-walled comforters should be made for safety reasons. However, this is not possible with available materials because otherwise the comforters obtained would not be sufficiently soft and elastic.

BRIEF DESCRIPTION OF THE INVENTION

The present invention provides a comforter which combines the favorable properties of relatively hard silicone rubber with its high tear propagation resistance with those of an extremely soft silicone rubber.

Accordingly, the present invention relates to a silicone rubber comforter for infants comprising an outer shell and a filling material, characterized in that the outer shell consists of a silicone rubber of high tear propagation resistance having a Shore A hardness of 30 to 60 and is filled with a soft silicone rubber having a Shore A hardness of less than 5, a chemical and/or mechanical bond being established at the interface between the outer shell and the filling material.

DETAILED DESCRIPTION

The comforter and/or pacifier of the present invention comprising an outer shell of silicone rubber and an inner filling of a softer silicone rubber is prepared by first forming a hollow body of a desired shape from the silicone rubber comprising the outer shell and then filling the hollow body with a softer silicone rubber filling material.

More particularly, the invention relates to a particularly durable comforter and pacifier based on silicon rubber. Initially, the comforter or pacifier outer shell in made as in the pact in the form of a hollow body of silicone rubber of high tear propagation resistance in the Shore A hardness range of 30 to 60 in a wall thickness of around 1 mm. Subsequently, the shell is filled with a special addition-crosslinking silicone rubber of extremely low Shore A hardness, followed by vulcanization by under the effect of heat, a chemical and mechanical bond with the other rubber being established between the shell ad filling at the same time.

The particular shape of the hollow body of silicone rubber prepared predetermines the shape of the comforter or pacifier of the present invention. Any convenient shape can be prepared. Conventional forms such as a nipple shape, donut shape or other conventional shapes are suitable for comforters and pacifiers according to the present invention.

Of course, the size and shape should be such that the comforter or pacifier can be easily gnawed, chewed or sucked by an infant.

In conventional processes, the hollow silicone rubber comforters are made form peroxide-crosslinking or addition-crosslinking silicone rubber by compression molding or injection molding, the rubber used being a one-component of two-component rubber.

Through the additional filling of such hollow bodies, of which the wall thickness can now be the reduced, with an extremely soft silicone elastomer, the local overstressing occurring during chewing, such as indentation, compression, shearing, can be reduced uniform deflection of the forcess occuring to the entire remaining surface to such extent that mechanical destruction by chewing its substantially impossible.

Another advantage of the comforter according to the invention is that the fillings in question, which basically have a neutral taste, may readily be treated with various flavorings, such as fruit, milk, chocolate flavorings and the like, the hence can be taken even better by infants. The necessary concentration of flavorings is less than 0.5% by weight.

The silicone elastomer required for the filing is produced from a vinyl-containing polysiloxane, an organohydrogen siloxane, reinforcing $SiO_2$ fillers and a catalyst, optionally in the presence of a retarder.

The vinyl-containing polysiloxane has the following general formula

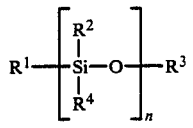

in which $R^1$, $R^2$, $R^3$ and $R^4$ may be alkyl groups containing up to 8 carbon atoms, aryl groups and vinyl groups, although at most only 2 vinyl groups are present per molecule, and n is the chain length of the polymer so that viscosities of from 0.1 to 3000,000 PA.s at 20° C. are obtained.

The organohydrogen siloxane, which is used in a quantity of 0.1 to 50 parts by weight, based on 100 parts vinyl-containing polysiloxane, corresponds to the following formula

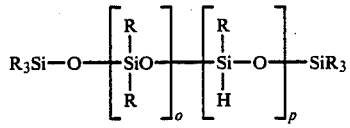

which R is an alkyl radical containing up to 8 carbon atoms, an aryl radical or a fluoroalkyl radical containing 3 to 8 carbon atoms, p has a value of or greater than 3 and o+p is varied so that the polymer has viscosity of 0.005 to 0.1 Pa.s at 25° C.

The catalyst is a platinum compound and is used in a 250 ppm. The Fillers are used in quantities of 0 to concentration of 1 to 200 parts.

What is claimed is:

1. In an improved rubber comforter or pacifier device for infants which comprises an outer shell and a filling material, the improvement comprises said outer shell being of silicone rubber of high tear propagation resistance having a Shore A hardness of 30 to 60 and filled with a soft addition crosslinking silicone rubber having a Shore A hardness of less than 5, with a chemical bond, mechanical bond, or both being established between the outer shell and the filling material.

2. A comforter or pacifier as claimed in claim 1 where in the outer shell is a peroxide- or addition-crosslinking solid silicone rubber or an addition-crosslinking liquid silicone rubber and the filling material is an addition-crosslinking gel, an addition- crosslinking liquid silicone rubber or a mixture of both.

3. A comforter or pacifier as claimed in claim 1 wherein the filling material is solid or foamed.

4. A comforter or pacifier as claimed in claim 1 wherein the material forming the outer shell or filling contains flavorings.

* * * * *